US005465495A

United States Patent [19]

Takubo

[11] Patent Number: 5,465,495

[45] Date of Patent: Nov. 14, 1995

[54] LENS SHAPE MEASURING INSTRUMENT

[75] Inventor: Sadao Takubo, Takehara, Japan

[73] Assignee: Kabushiki Kaisha Takubo Seiki Seisakusho, Takehara, Japan

[21] Appl. No.: 252,882

[22] Filed: Jun. 2, 1994

[30] Foreign Application Priority Data

Jun. 28, 1993 [JP] Japan ..... 5-182019

[51] Int. Cl.[6] ..... G01B 5/20

[52] U.S. Cl. ..... 33/507; 33/200

[58] Field of Search ..... 33/507, 200, 28

[56] References Cited

U.S. PATENT DOCUMENTS

| | | | |
|---|---|---|---|
| 1,389,912 | 9/1921 | Stead | 33/507 |
| 2,646,627 | 7/1953 | Tillyer et al. | 33/507 |
| 3,981,081 | 9/1976 | Welch | 33/507 |
| 4,299,032 | 11/1981 | Young | 33/200 |
| 4,383,393 | 5/1983 | Takubo . | |
| 4,676,004 | 6/1987 | Nakamura et al. | 33/200 |
| 4,776,101 | 10/1988 | Ishibai | 33/507 |
| 4,979,311 | 12/1990 | Bizer et al. | 33/200 |

FOREIGN PATENT DOCUMENTS

| | | | |
|---|---|---|---|
| 58-43227 | 9/1983 | Japan . | |
| 61-257750 | 11/1986 | Japan . | |
| 97801 | 4/1989 | Japan | 33/507 |
| 158714 | 7/1991 | Japan | 33/833 |
| 9598 | of 1892 | United Kingdom | 33/507 |

*Primary Examiner*—Christopher W. Fulton
*Attorney, Agent, or Firm*—Nields & Lemack

[57] ABSTRACT

A lens shape measuring instrument includes a slide base plate in parallel with a chucking shaft of an eyeglass lens, a flat contactor arranged on a first measuring bar disposed on a first rotating shaft, and a V-shaped contactor disposed on a second measuring bar disposed on a second rotating shaft, so that the flat contactor and the V-shaped contactor can be brought into contact with the peripheral surface of the eyeglass lens at the same time. The thickness center of the peripheral surface of the eyeglass lens can be detected by detecting positional change of the slide base plate, and the thickness of the peripheral surface of the eyeglass lens can be detected by rotation difference between the first rotating shaft and the second rotating shaft corresponding to the positional change and from shape of the V-shaped contactor.

10 Claims, 6 Drawing Sheets

LENS SHAPE MEASURING INSTRUMENT

BACKGROUND OF THE INVENTION

The present invention relates to a lens shape measuring instrument for measuring data required for grinding the end surface of an eyeglass lens, particularly the thickness and thickness center of the end surface of an eyeglass lens.

In order to engage an eyeglass lens correctly and properly into an eyeglass frame, the eyeglass lens must be ground in such manner that the peripheral surface of the eyeglass lens fits a groove on the eyeglass frame and that the planar shape of the eyeglass lens fits the planar shape of the eyeglass frame. Also, the convex projection (convex projection on the periphery of the eyeglass lens) must be formed on the end surface of the lens so as to fit the groove of the eyeglass frame.

The present applicant has proposed an automatic lens grinder for grinding the peripheral surface of an eyeglass lens so as to form a convex projection which accurately fits the groove of an eyeglass frame and has disclosed same in Japanese Patent Publication No. 58-43227 and Japanese Patent Application No. 60-97295.

In the invention of said Japanese Patent Publication No. 58-43227 and Japanese Patent Application No. 60-97295, an eyeglass lens is movably supported in the direction of an optical axis, and the end surface of the eyeglass lens is brought into contact with a grindstone having a V-groove. The end surface of the eyeglass lens is moved along the V-groove when the eyeglass lens is rotated by one turn by rotating the eyeglass lens grindstone, and the thickness center of the end surface of the eyeglass lens is measured based on the movement of the lens in the direction of its optical axis. The distance between the end surface of the eyeglass lens and the optical center of the lens is measured by means of the movement of the lens in a vertical direction.

According to the conventional method, to measure the thickness and thickness center of the end surface of an eyeglass lens, contactors are attached on the front surface and rear surface of the eyeglass lens, and the front surface and rear surface of the contactors are detected, and the distance between the two detected positions is detected by a distance detector such as an encoder.

With rapid propagation of very thin plastic lenses in recent years, there are many lenses which have narrower cutting allowance and which are made of soft lens material. In this respect, according to the invention of Japanese Patent Publication No. 58-43227 and Japanese Patent Application No. 60-97295, cutting allowance may be scraped off before the width center of the grindstone corresponds with the thickness center of the lens end surface. If contact pressure on the grindstone is reduced to decrease the amount cut from the lens, smooth sliding in the direction of inclination of the grindstone does not occur between the lens and the inclined surface depending upon each condition, and the lens ascends the inclined surface. As a result, the lens cannot follow the center of the V-groove, and the thickness center of the lens end surface may not be measured.

In case the contactor is attached on the front surface and rear surface of the eyeglass lens as described above, the surface of the eyeglass lens may be damaged. Also, complicated mechanisms such as sensor installing and moving mechanism or distance measuring mechanism are required, thereby resulting in higher cost.

SUMMARY OF THE INVENTION

It is an object of the present invention to provide a lens shape measuring instrument which has a simple structure and by which it is possible to measure the thickness and thickness center of the end surface of a lens in an accurate and reliable manner even when the lens is very thin and is made of soft material, such as a plastic lens.

To attain the above object, the instrument according to the present invention comprises a slide base plate slidably mounted in parallel with a chucking shaft of an eyeglass lens, a first rotating shaft is disposed in parallel with the chucking shaft on the slide base plate, a second rotating shaft concentric with the first rotating shaft is disposed, a first measuring bar and a second measuring bar are arranged on the first rotating shaft and the second rotating shaft respectively, a flat contactor is disposed on the tip of the first measuring bar, a V-shaped contactor is disposed on the tip of the second measuring bar, the flat contactor and the V-shaped contactor being attachable on the peripheral surface of the eyeglass lens at the same time so that any rotation difference between the first and the second rotating shafts can be detected and displacement of the slide base plate can be detected. By bringing the V-shaped contactor to the peripheral surface of the eyeglass lens, a tracing effect by V-shape is obtained, the slide base plate follows up positional change of peripheral surface of the eyeglass lens in optical axis direction. By detecting the positional change of the slide base plate, the thickness center of the peripheral surface of the eyeglass lens can be detected. Rotating difference between the first rotating shaft and the second rotating shaft occurs due to change of contact position, which is caused by the shape when the flat contactor and the V-shaped contactor are brought into contact with the peripheral surface of the eyeglass lens at the same time, and the thickness of the peripheral surface of the eyeglass lens is detected by the rotating difference and the shape of the V-shaped contactor.

DETAILED DESCRIPTION OF THE PREFERRED EMBODIMENT

Figure 1:
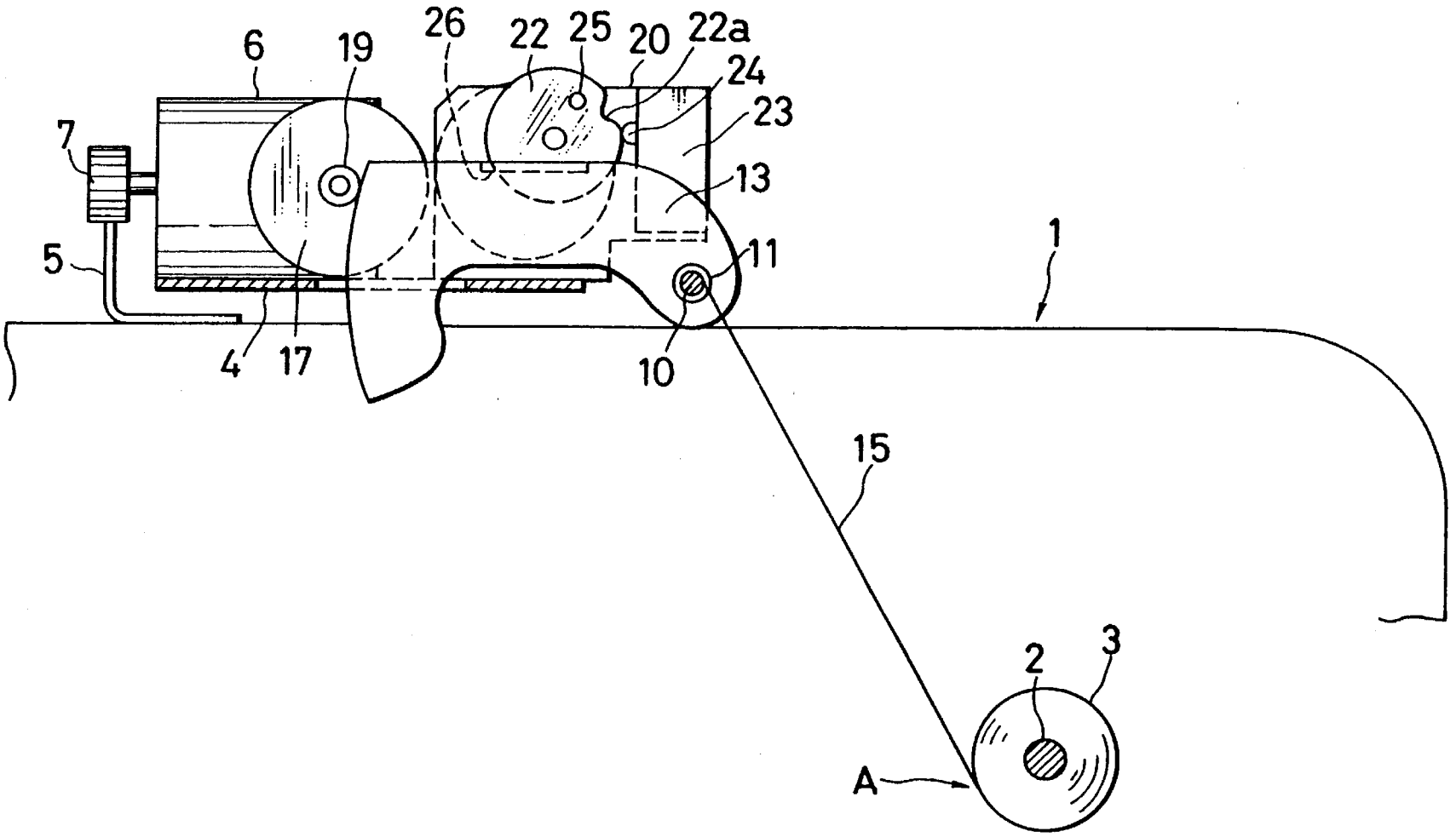
FIG. 1 is a side view of an essential part of an embodiment of the present invention.
Figure 2:
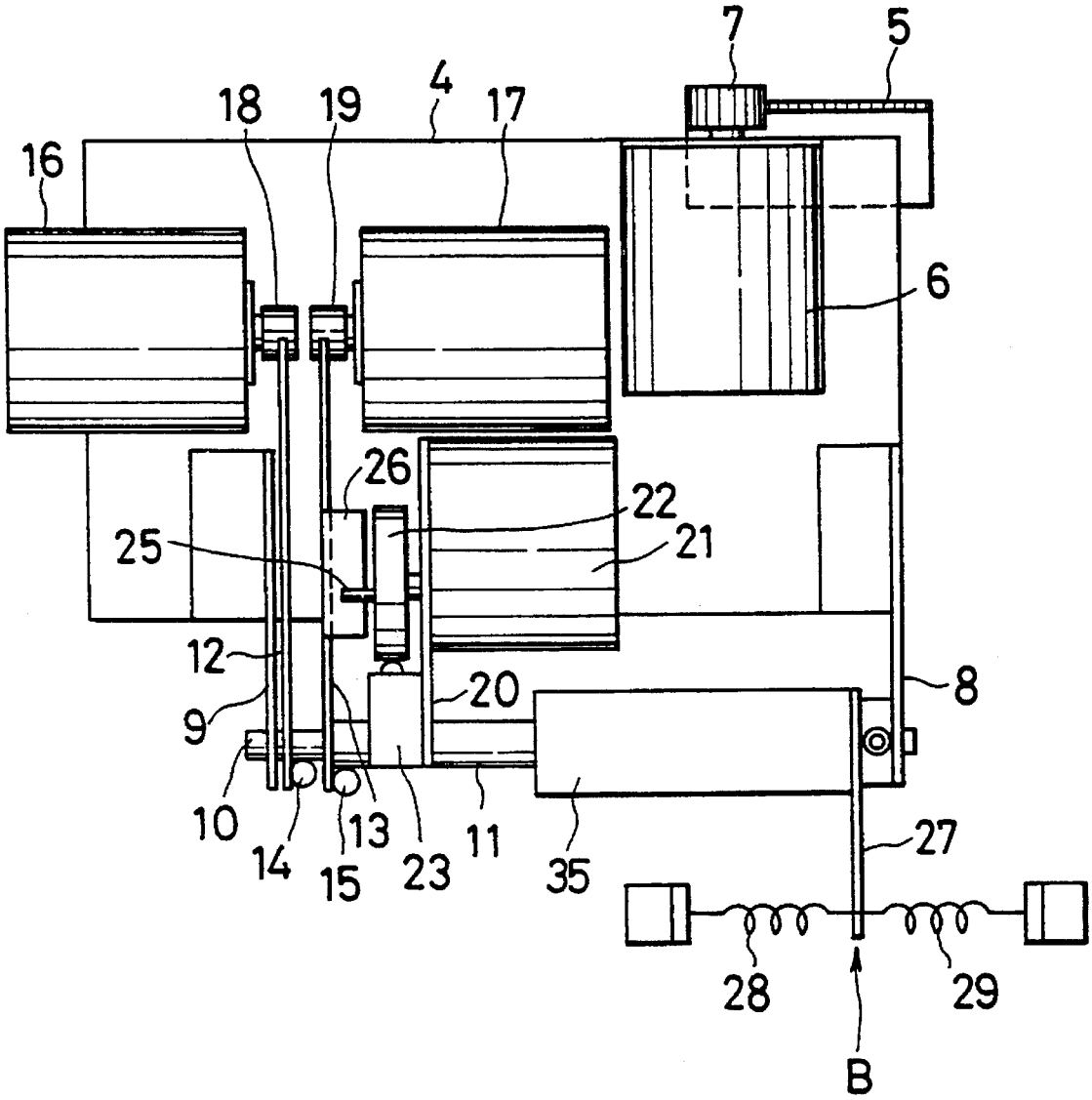
FIG. 2 is a front plan view of the same.

In the following, an embodiment of the present invention will be described, referring to the drawings.

In the figures, reference numeral 1 represents a main unit of a lens grinder, and 2 is a chucking shaft mounted on the lens grinder main unit 1. The chucking shaft 2 chucks an eyeglass lens 3 and is rotatable.

On the top surface of the lens grinder main unit 1, a slide base plate 4 is slidably mounted in the direction of the shaft center of the chucking shaft 2. On the top surface of the lens grinder main unit 1, a rack gear 5 is disposed in parallel with the sliding direction of the slide base plate 4. On the slide base plate 4, a horizontal displacement detecting encoder 6 is arranged, and a gear 7 is engaged on the rotating shaft of the horizontal displacement detecting encoder 6, and the gear 7 is engaged with the rack gear 5. On the slide base plate 4, brackets 8 and 9 are arranged on a side opposite to the horizontal displacement detecting encoder 6 as projecting from the slide base plate 4. By the brackets 8 and 9, two ends of a shaft 10 are rotatably supported, and the shaft is rotatably inserted in a pipe shaft 11.

The pipe shaft 11 is slidably supported by a bearing block 35.

A first gear lever 12 extending in a horizontal direction is fixed on the shaft 10, and a second gear lever 13 extending in a horizontal direction is fixed on the pipe shaft 11. The second gear lever 13 and the first gear lever 12 have an external shape identical to each other, and each has an arc gear unit at its forward end. The second gear lever 13 has a overhang piece 26 which is formed by bending a top portion of itself horizontally.

Figure 3:
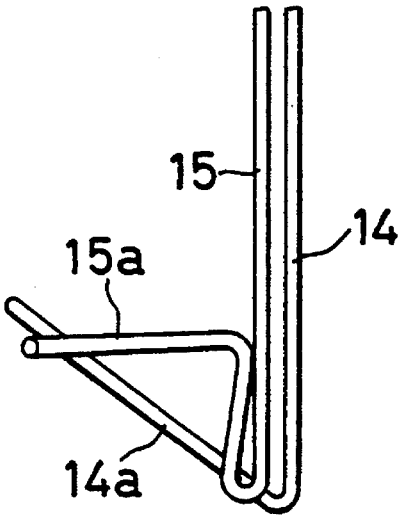
FIG. 3 is a view in the direction of the arrow A of FIG. 1.

A first measuring bar 14 extending downward is fixed on the shaft 10, and a second measuring bar 15 extending downward is fixed on the pipe shaft 11. On the tip of the first measuring bar 14, a flat contactor **14*a* bent at a right angle is provided so that the flat contactor 14*a* is brought into contact with the peripheral surface of the eyeglass lens 3. On the tip of the second measuring bar 15, a V-shaped contactor 15*a* is provided, which is bent at 45° within a plane crossing perpendicularly to the second measuring bar 15, further being folded back at 90°, formed angularly and opened toward the outside. The width of a V-groove of the V-shaped contactor 15*a* is sufficiently wider than the width of the peripheral surface of the eyeglass lens 3 so that the V-shaped contactor 15*a* is brought into contact with the peripheral surface of the eyeglass lens 3. The relation between the flat contactor 14*a* and the V-shaped contactor 15*a* is such that the flat contactor 14 traverses the V-groove of the V-shaped contactor 15*a*, and nevertheless the two contactors do not interfere with each other, as shown in FIG. 3**.

The flat contactor **14*a* and the V-shaped contactor 15*a* may be individual components independent of the first measuring bar 14 and the second measuring bar 15**, so that each of them can be changed respectively when they are worn away or broken off.

Between the first gear lever 12 and the second gear lever 13, a stopper (not shown) is provided, which is engaged with the two gear levers which overlap each other. Also, when the first gear lever 12 and the second gear lever 13 overlap each other, the first measuring lever 14 and the second measuring lever 15 also overlap each other.

A torsion coil spring (not shown) is provided between the shaft 10 and the pipe shaft 11, pushing the first gear lever 12 and the second gear lever 13 so as to keep an overlapped condition. 0n the pipe shaft 11, a lever 27 is fixed on the side opposite to the second gear lever 13, and springs for applying measuring pressure (e.g. springs 28 and 29 as described later) are provided between the lever 27 and the lens grinder main unit 1, pushing the first gear lever 12 and the second gear lever 13 counterclockwise in FIG. 1.

A first encoder 16 and a second encoder 17 each having a rotating shaft center in parallel with the shaft center of the shaft 10 are disposed symmetrically on the slide base plate 4, and a gear 18 is arranged on the rotating shaft of the first encoder 16 and is engaged with the first gear lever 12. A gear 19 is arranged on the rotating shaft of the second encoder 17 and is engaged with the second gear lever 13.

A motor support plate 20 is erected on the slide base plate 4 between the second encoder 17 and the pipe shaft 11, and a motor 21 is provided in parallel with the pipe shaft 11 on the motor support plate 20, and a base point setting cam 22 is engaged on an output shaft of the motor 21. A microswitch 23 is disposed on the motor support plate 20 at an opposing position to the base point setting cam 22.

The base point setting cam 22 is provided with a recess **22*a*, and when the recess 22*a* is engaged with an operating button 24 of the microswitch 23, the microswitch 23 is operated, issuing a base point setting signal. A pin 25 is arranged on the base point setting cam 22, and the pin 25 is engagable with the overhang piece 26 on the second gear lever 13 only by a predetermined rotating angle of the base point setting cam 22, and the second gear lever 13 is rotatable counterclockwise in FIG. 1 via the overhang piece 26**.

Figure 4:
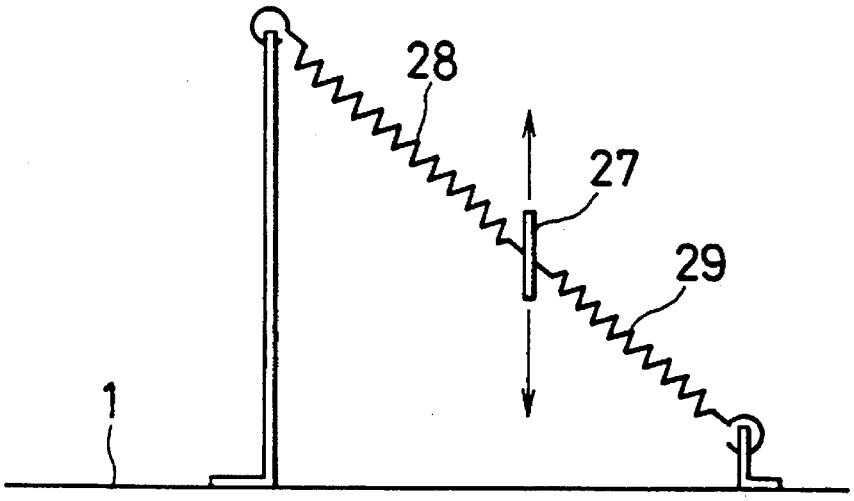
FIG. 4 is a view in the direction of the arrow B of FIG. 2.

On the shaft end opposite to the second gear lever 13 of pipe shaft 11, a lever 27 is fixed, and the springs 28 and 29 having different spring properties are connected to the tip of the lever 27, as shown in FIG. 4, in a direction crossing the rotating plane of the lever 27, and the springs 28 and 29 are also connected to the lens grinder main unit 1.

Figure 5:
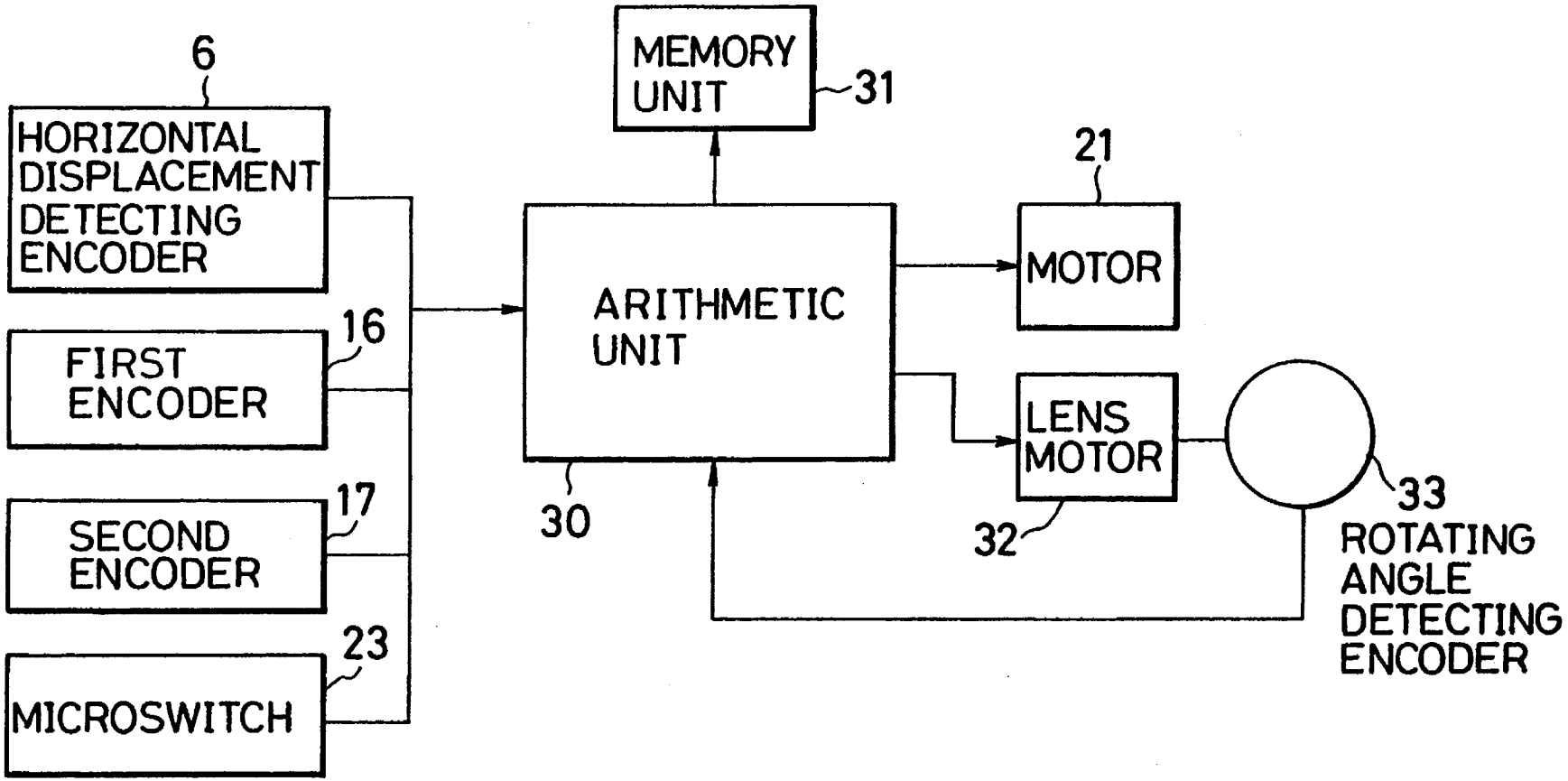
FIG. 5 is a circuit block diagram of the above embodiment.

FIG. 5 is a circuit block diagram of the present embodiment.

Signals from the horizontal displacement detecting encoder 6, the first encoder 16, the second encoder 17, the microswitch 23, etc. are inputted to an arithmetic unit 30, and signals from a rotating angle detecting encoder 33 connected to a lens motor 32, which rotates the eyeglass lens 3, are inputted to the arithmetic unit 30, and the thickness and thickness center of the end surface of the eyeglass lens 3 are calculated from these signals. The calculated results are inputted and stored in a memory unit 31 and are used as control data when the end surface of the lens is ground to form a convex projection.

The operation will now be described.

When power to the lens shape measuring instrument is turned on, the motor 21 is driven, and the base point setting cam 22 is rotated. The pin 25 is engaged with the lower surface of the overhang piece 26. When rotated against the force of the spring for applying measuring pressure (not shown), the second gear lever 13 is rotated clockwise in FIG. 1. The second gear lever 13 and the first gear lever 12 overlap each other via the stopper (not shown) and the torsion coil spring (not shown), and the second gear lever 13 and the first gear lever 12 are integrally rotated.

Further, as the base point setting cam 22 is rotated, the recess **22*a* passes through the operating button 24, and the microswitch 23 is operated and the base point is confirmed. The base point confirming signal is inputted to the arithmetic unit 30, and the results of input from the horizontal displacement detecting encoder 6, the first encoder 16, the second encoder 17, and the rotating angle detecting encoder 33** are set to 0.

The eyeglass lens 3 is chucked on the chucking shaft 2, and the base point setting cam 22 is rotated by the motor 21, and the pin 25 is separated from the overhang piece 26. By the spring for applying measuring pressure, the first gear lever 12 and the second gear lever 13 are integrally rotated counterclockwise, and the first measuring bar 14 and the second measuring bar 15 are also rotated counterclockwise. The flat contactor **14*a* and the V-shaped contactor 15*a* are brought into contact with the peripheral surface of the eyeglass lens 3**.

Here, the external shape of the eyeglass lens 3 is formed not in circular shape, but in a shape closer to an ellipse or rectangle to match the lens frame. Thus, the position of the peripheral surface of the lens is moved in a radial direction and also in the direction of the optical axis when rotated around the optical axis of the lens. In order to accurately bring the flat contactor 14*a* and the V-shaped contactor 15*a* into contact with the peripheral surface of the eyeglass lens 3, the slide base plate 4 must be moved toward the direction of the shaft center of the chucking shaft 2. The movement of the slide base plate 4 is induced by cooperative movement of the lever 27 integrally rotated with the pipe shaft 11 and of the springs 28 and 29.

Figure 6:
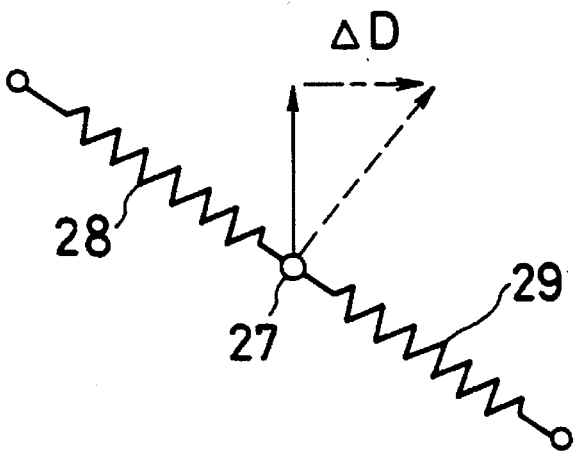
FIG. 6 is a schematical drawing showing operation of a slide base plate following the position of the peripheral surface of an eyeglass lens.

As described above, the springs 28 and 29 have different spring properties. As it is evident in FIG. 4, the operating line of the springs 28 and 29 crosses the rotating direction of the lever 27. Therefore, displacement of the springs 28 and 29 changes when the lever 27 is rotated. For example, when the lever 27 moves upward in FIG. 4, the spring 28 contracts, and the spring 29 is expanded. Accordingly, the balance of force between the springs 28 and 29 is lost, and the tensile force of the spring 29 increases against the spring 28. Because the slide base plate 4, where the lever 27 is mounted, is slidable in a horizontal direction, the lever 27 is also moved in a horizontal direction by ΔD while rotating as shown in FIG. 6.

The rotation of the lever 27 is induced by the rotation of the second measuring lever 15, and the rotation of the second measuring lever 15 is induced by the change of radius around the optical axis of the eyeglass lens 3, which the V-shaped contactor 15*a* contacts. Because positional change of the peripheral surface of lens in the direction of the optical axis is proportional to the change of radius around the optical axis of the peripheral surface of the lens, if the properties of the springs 28 and 29 are adequately selected and the value of ΔD caused by rotation of the lever 27 is properly matched to the positional change of the peripheral surface of the lens in the direction of the optical axis, the V-shaped contactor 15*a* and the flat contactor 14*a* are always and properly brought into contact with the peripheral surface of the eyeglass lens 3. Further, no expensive driving means such as a motor is required for horizontal driving, and a control system is not needed.

Further, it is needless to say that the springs 28 and 29 exert action on a restoring force in the rotating direction of the lever 27, and contact pressure of the flat contactor 14*a* and the V-shaped contactor 15*a* on the peripheral surface of the eyeglass lens is given by the springs 28 and 29.

There are several lens curves, but the properties of the springs 28 and 29 may be designed to match a standard lens curve, or they may be changed depending upon the lens curve. Or, the springs 28 and 29 may be provided vertically with respect to the rotating plane of the lever 27. In this case, the spring constants of the springs 28 and 29 are changed or mounting lengths of the spring 28 and the spring 29 are changed. Further, by selecting the crossing angle between the rotating plane of the lever 27 and the operating line of the springs,the springs 28 and 29 may be designed with the same property.

The flat contactor 14*a* and the V-shaped contactor 15*a* move and follow the peripheral surface of the eyeglass lens 3. That is, the slide base plate 4 moves, and displacement of the slide base plate 4 is detected by the horizontal displacement detecting encoder 6.

Next, the position of the V-shaped contactor 15*a* indicates the position of the peripheral surface of the eyeglass lens 3 in a radial direction. Further, the position of the V-shaped contactor 15*a* is detected by the rotating angle of the second gear lever 13, which is integrally rotated with the second measuring bar 15. Further, the rotation amount of the second gear lever 13 is detected by the second encoder 17 via the gear 19. The position of the flat contactor 14*a* also indicates the position in a radial direction of the peripheral surface of the eyeglass lens 3, and the position in a radial direction of the eyeglass lens 3 may be obtained from the first encoder 16 via the first gear lever 12.

Figure 7A:
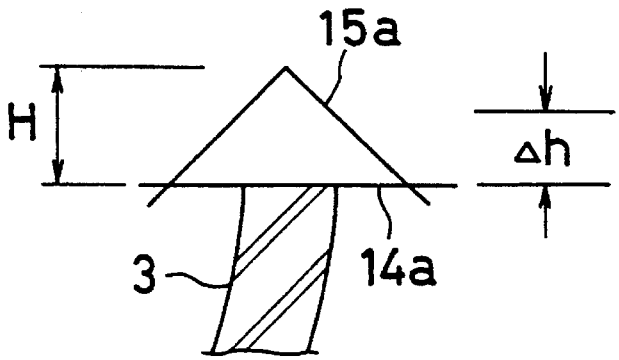
FIGS. 7(A) and 7(B) represent drawings showing operation when the thickness of the peripheral surface of an eyeglass lens is measured.
Figure 7B:
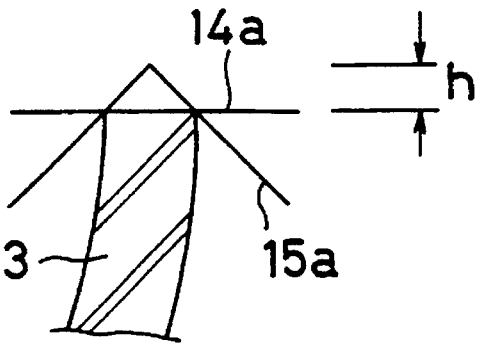

Further, the thickness and thickness center of the peripheral surface of the eyeglass lens 3 are detected by rotation difference between the second gear lever 13 and the first gear lever 12. When the first gear lever 12 and the second gear lever 13 match each other, the detection signal from the first encoder 16 and the second encoder 17 are set to 0 by the microswitch 23. Under this 0 setting condition, positional relationship of the flat contactor 14*a* and the V-shaped contactor 15*a* is as shown in FIG. 3 and FIG. 7 (A), and the flat contactor 14*a* traverses the width of the V-groove of the V-shaped contactor 15*a*. Under this condition, the distance H from the apex of the V-groove to the flat contactor 14*a* is set when the instrument is adjusted, and it is set and inputted to the arithmetic unit 30.

The pin 25 is deviated from the overhang piece 26, and the first measuring bar 14 and the second measuring bar 15 are integrally rotated by the restoring force of the spring for applying measuring pressure (not shown). First, the flat contactor 14*a* is brought into contact with the peripheral surface of the eyeglass lens 3, and this restrains the movement of the first measuring bar 14. On the other hand, a movement amount of Δh is further needed until the V-shaped contactor 15*a* is brought into contact with the peripheral surface of the eyeglass lens 3 as shown in FIG. 7 (B). There occurs a difference of Δh in movement amount between the flat contactor 14*a* and the V-shaped contactor 15*a*. The value of Δh can be obtained from the difference of the detection results between the first encoder 16 and the second encoder 17, which are detected via the first gear lever 12 and the second gear lever 13.

By obtaining the value of Δh, the difference h from the above-mentioned H can be determined. Because the V-shaped contactor 15*a* is in the shape of an isosceles right-angled triangle, it is immediately determined that the thickness of the peripheral surface of the eyeglass lens 3 is 2h. The groove angle of the V-shaped contactor 15*a* does not have to be 90°, and it may be any known angle.

Further, by pressing the V-shaped contactor 15*a* on the peripheral surface of the eyeglass lens 3, the apex of the V-groove of the V-shaped contactor 15*a* always follows the thickness center of the peripheral surface of the eyeglass lens 3. By the detection results of the horizontal displacement detecting encoder 6, the thickness center of the peripheral surface is inevitably detected.

It is needless to say that various detection results as described above are matched to the detection results from the rotating angle detecting encoder 33 and are stored in the memory unit 31.

In the above embodiment, various types of measuring means such as linear encoder, differential transformer, etc. may be used instead of the encoder.

Figure 8:
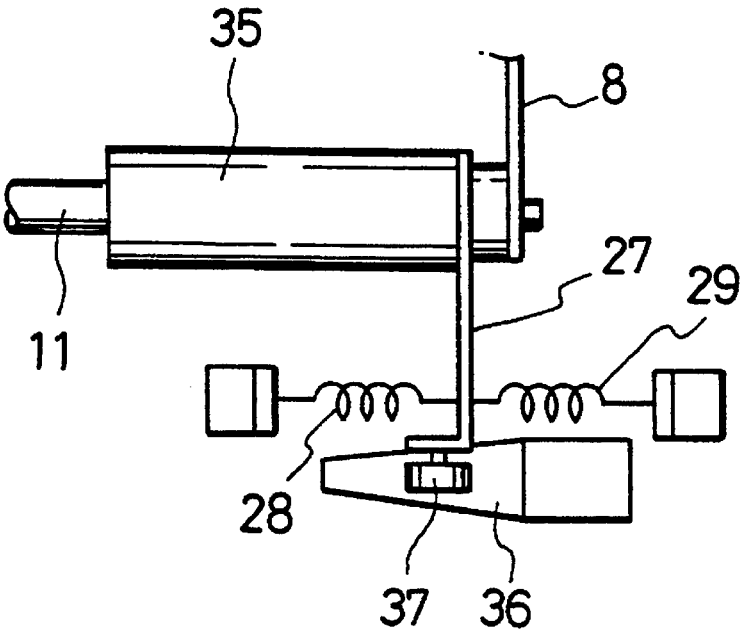
FIGS. 8 and 9 are drawings showing use of an auxiliary guide for the condition in which slight friction operates at sliding of the slide base plate.
Figure 9:
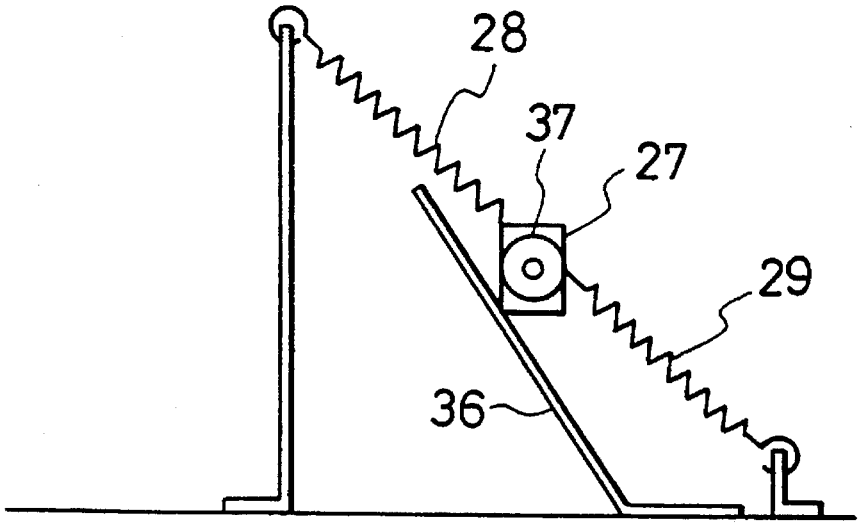

Further, description will be given about movement of the slide base plate 4. Slight friction operates at sliding of the slide base plate 4. This friction may have a subtle effect on the balance of force between the springs 28 and 29. An auxiliary guide 36 for the above condition is shown in FIG. 8 and 9.

The auxiliary guide 36 is a leaf spring tapering away to the end in width, and mounted with inclination on the top surface of the lens grinder main unit 1.

A roller 37 is disposed rotatably on the end of the lever 27, and a force in a horizontal direction is applied to the lever 27 by bringing the roller 37 into contact with the auxiliary guide 36. As the auxiliary guide 36 is mounted for the purpose of assisting the springs 28 and 29, the auxiliary guide 36 may have small operation force Therefore, its thickness is thin and its width narrows toward the end.

As the force in a horizontal direction is applied to the lever 27 by the auxiliary guide 36 through the roller 37, the slide base plate 4 cancels the effect of the friction, and the slide base plate 4, that is, the V-shaped contactor 15*a* moves and follows exactly the peripheral surface of the eyeglass lens 3, and the position of the peripheral surface of the eyeglass lens 3 is detected by the horizontal displacement detecting encoder 6.

As described above, it is possible by the present instrument to measure all data necessary for eyeglass lens grinding such as radius, thickness of peripheral surface, thickness center of peripheral surface, etc. of an eyeglass lens.

It is possible according to the present invention to simplify the structure of the instrument and to measure the thickness and thickness center of the end surface of a lens in an accurate and reliable manner without damaging the lens surface even in case of thin plastic lens made of soft material.

What I claim are:

1. A lens shape measuring instrument, comprising a slide base plate slidably provided in parallel with a chucking shaft of an eyeglass lens, a rotating shaft disposed in parallel with the chucking shaft on the slide base plate, a measuring bar arranged on the rotating shaft and having a tip and a V-shaped contactor formed on said tip, a spring for applying measuring pressure disposed so that the V-shaped contactor can be pressed on the peripheral surface of the eyeglass lens, and a detector for detecting horizontal displacement of the slide base plate.

2. A lens shape measuring instrument, comprising a first rotating shaft in parallel with a chucking shaft of an eyeglass lens, a second rotating shaft concentric to the first rotating shaft, a first measuring bar provided on the first rotating shaft and having a tip, a second measuring bar provided on the second rotating shaft and having a tip, a flat contactor formed at the tip of the first measuring bar, a V-shaped contactor formed at the tip of the second measuring bar so that the flat contactor and the V-shaped contactor can be respectively brought into contact with the peripheral surface of the eyeglass lens at the same time, and detectors detecting rotation difference between the first rotating shaft and the second rotating shaft.

3. A lens shape measuring instrument, comprising a slide base plate slidably provided in parallel with a chucking shaft of an eyeglass lens, a first rotating shaft disposed on the slide base plate in parallel with the chucking shaft, a second rotating shaft concentric to the first rotating shaft, a first measuring bar provided on the first rotating shaft and having a tip, a second measuring bar provided on the second rotating shaft and having a tip, a flat contactor formed at the tip of the first measuring bar, a V-shaped contactor formed at the tip of the second measuring bar so that the flat contactor and the V-shaped contactor can be respectively brought into contact with the peripheral surface of the eyeglass lens at the same time, detectors detecting the rotation difference between the first rotating shaft and the second rotating shaft, and a detector detecting horizontal displacement of the slide base plate.

4. A lens shape measuring instrument according to one of claims 1 or 3, wherein a lever is provided on the second rotating shaft, and two springs arranged at opposed position are engaged with the lever so as to have operating line crossing the rotating plane of the lever

5. A lens shape measuring instrument according to one of claims 2 or 3, wherein a first gear lever is provided on the first rotating shaft, a second gear lever is provided on the second rotating shaft, the first gear lever is engaged with a gear mounted on a first encoder, the second gear lever is engaged with a gear mounted on a second encoder so that rotation difference between the first rotating shaft and the second rotating shaft can be detected by the encorders.

6. A lens shape measuring instrument according to any one of claims 1, 2, or 3, wherein position of a contactor of the measuring bar is detected so that external shape of the eyeglass lens can be detected.

7. A lens shape measuring instrument according to any one of claims 2 or 3, wherein an angle of said V-shaped contactor is a known angle, and thickness of end surface of the eyeglass lens is detected by detecting rotation difference between the first rotating shaft and the second rotating shaft.

8. A lens shape measuring instrument according to claim 4, wherein a roller is provided on the end of the lever provided on the second rotating shaft, an auxiliary guide which can be contact with the roller is mounted on lens grinder main unit, and the auxiliary guide is a leaf spring.

9. A lens shape measuring instrument according to claim 5, wherein position of a contactor of the measuring bar is detected so that external shape of the eyeglass lens can be detected.

10. A lens shape measuring instrument according to claim 5, wherein an angle of said V-shaped contactor is a known angle, and thickness of end surface of the eyeglass lens is detected by detecting rotation difference between the first rotating shaft and the second rotating shaft.

* * * * *